US009118098B2

(12) United States Patent
Kai

(10) Patent No.: US 9,118,098 B2
(45) Date of Patent: Aug. 25, 2015

(54) COAXIAL WAVEGUIDE CONVERTER AND RIDGE WAVEGUIDE

(75) Inventor: Takafumi Kai, Tokyo (JP)

(73) Assignee: NEC CORPORATION, Tokyo (JP)

( * ) Notice: Subject to any disclaimer, the term of this patent is extended or adjusted under 35 U.S.C. 154(b) by 168 days.

(21) Appl. No.: 13/993,881

(22) PCT Filed: Nov. 28, 2011

(86) PCT No.: PCT/JP2011/006600

§ 371 (c)(1),
(2), (4) Date: Jun. 13, 2013

(87) PCT Pub. No.: WO2012/101699

PCT Pub. Date: Aug. 2, 2012

(65) Prior Publication Data

US 2013/0271235 A1 Oct. 17, 2013

(30) Foreign Application Priority Data

Jan. 25, 2011 (JP) ..... 2011-012702

(51) Int. Cl.

| | |
|---|---|
| ***H01P 5/103*** | (2006.01) |
| ***H01P 5/08*** | (2006.01) |
| ***H01P 3/00*** | (2006.01) |
| *H01P 3/123* | (2006.01) |

(52) U.S. Cl.
CPC .. *H01P 5/08* (2013.01); *H01P 3/00* (2013.01); *H01P 5/103* (2013.01); *H01P 3/123* (2013.01)

(58) Field of Classification Search
USPC ..... 333/26, 33–34, 254, 260
See application file for complete search history.

(56) References Cited

U.S. PATENT DOCUMENTS

| | | | | |
|---|---|---|---|---|
| 4,652,839 | A * | 3/1987 | Tadachi et al. | 333/26 |
| 5,708,401 | A * | 1/1998 | Umezu | 333/26 |
| 7,812,686 | B2 * | 10/2010 | Woods et al. | 333/26 |

FOREIGN PATENT DOCUMENTS

| | | | |
|---|---|---|---|
| CN | 2836255 | Y | 11/2006 |
| DE | 29818848 | U1 | 1/1999 |
| GB | 821150 | A | 9/1959 |
| JP | 58-23406 | U | 2/1983 |

(Continued)

OTHER PUBLICATIONS

Extended European Search Report dated May 28, 2014, issued by the European Patent Office in corresponding European Application No. 11857294.0.

(Continued)

*Primary Examiner* — Dinh Le
(74) *Attorney, Agent, or Firm* — Sughrue Mion, PLLC

(57) ABSTRACT

Provided is a coaxial waveguide converter and a ridge waveguide that are insusceptible to manufacturing variances over a broad bandwidth. The coaxial waveguide converter includes a ridge waveguide (10) including a ridge (11) and a coaxial line (20). A projection (12) projecting toward a side of a waveguide space (13) is provided in the ridge (11), an amount of projection of the projection (12) decreases gradually from an end surface of the ridge waveguide (10) on a side of the coaxial line along a waveguide direction and an inner conductor (21) of the coaxial line (20) is inserted in the through-hole (14) at a position displaced from a center of the ridge waveguide (10) in a direction perpendicular to a direction in which the projection (12) projects in the end surface of the ridge waveguide (10) on the side of the coaxial line.

9 Claims, 7 Drawing Sheets

(56) References Cited

FOREIGN PATENT DOCUMENTS

| | | | |
|---|---|---|---|
| JP | 61134103 | U | 8/1986 |
| JP | 6277903 | U | 5/1987 |
| JP | 235801 | A | 2/1990 |
| JP | 5-299907 | A | 11/1993 |
| JP | 6-18287 | B2 | 3/1994 |
| JP | 7-154101 | A | 6/1995 |
| JP | 9-130108 | A | 5/1997 |

OTHER PUBLICATIONS

Communication dated Jul. 25, 2014 from the State Intellectual Property Office of the People's Republic of China in counterpart application No. 201180065890.9.

* cited by examiner

COAXIAL WAVEGUIDE CONVERTER AND RIDGE WAVEGUIDE

CROSS REFERENCE TO RELATED APPLICATIONS

This application is a National Stage of International Application No. PCT/JP2011/006600 filed Nov. 28, 2011, claiming priority based on Japanese Patent Application No. 2011-012702 filed Jan. 25, 2011, the contents of all of which are incorporated herein by reference in their entirety.

TECHNICAL FIELD

The present invention relates to a coaxial waveguide converter and a ridge waveguide.

BACKGROUND ART

A ridge waveguide has a lower cutoff frequency than a rectangular waveguide, thereby exhibiting broadband transmission characteristics (patent literature 1). Since the ridge waveguide has favorable transmission characteristics also in the low frequency band, the ridge waveguide can be realized in a smaller size than the rectangular waveguide at the same design frequency. Adopting the ridge waveguide as a transmission line of a radio frequency circuit has an advantage of realizing the radio frequency circuit in a physically smaller space at the same design frequency.

CITATION LIST

Patent Literature

Patent literature 1: Japanese Examined Patent Application Publication No. H06-18287

SUMMARY OF INVENTION

Technical Problem

As a converter of the coaxial and ridge waveguide, there is an H-plane coupled configuration in which an inner conductor is inserted from an H-plane. Further, there are a short circuit type and an open circuit type in the H-plane coupled configuration. This configuration is explained using FIGS. 9 to 11. FIG. 9 is a perspective diagram schematically showing an H-plane coupled coaxial waveguide converter. FIG. 10 is a side view showing a connection configuration of the short circuit type, and FIG. 11 is a cross-sectional view showing a connection configuration of the open circuit type.

As shown in FIG. 9, an inner conductor 61 of a coaxial line 60 is electromagnetically coupled to a ridge waveguide 50 from an H-plane (magnetic field plane). A dielectric 62 is provided on an outer circumference of the inner conductor 61. Moreover, a ridge 51 is provided in the ridge waveguide 50. Then, a waveguide space 52 has a concave shape in its cross section. A configuration in which an end of the inner conductor 61 comes into contact with the ridge 51 is the short circuit type shown in FIG. 10, while the configuration in which the end of the inner conductor 61 is not in contact with the ridge 51 is the open circuit type shown in FIG. 11.

In the open circuit type shown in FIG. 11, the electromagnetic field coupling of the inner conductor 61 strongly depends on capacitance formed between a lower surface of the end of the inner conductor 61 and an upper surface of the ridge waveguide 50. Therefore, the open circuit type has features in which fluctuation in characteristics associated with a change in H is extremely large. FIG. 12 shows return loss characteristics of a 7 GHz model open circuit type. As shown in FIG. 12, return loss deteriorates below −20 dB by a change of only 0.05 mm in the distance H between the lower surface of the end of the inner conductor 61 and the upper surface of the ridge waveguide 50. Therefore, there is a problem in which characteristics greatly deteriorate due to manufacturing variances.

On the other hand, characteristics are stabilized in the short circuit type shown in FIG. 10. However, the inner conductor 61 is coupled to an electromagnetic field in the ridge waveguide 50 too strongly, thereby hindering impedance matching. Moreover, it is difficult to realize stable electric contact for manufacturing reasons. FIG. 13 shows frequency characteristics of return loss of a 7 GHz model short circuit type. As shown in FIG. 13, merely inserting the inner conductor 61 to make a connection achieves return loss of only about −7 dB. Further, in the H-plane coupled coaxial waveguide converter, the frequency characteristics strongly depend on a dimension of the inner conductor in order to achieve broadband characteristics. Therefore, a step is often formed in the inner conductor to match impedance, and in many cases, this complicates the configuration for manufacturing reasons.

As has been described, there is a problem in the H-plane coupled coaxial waveguide converter that the H-plane coupled coaxial waveguide converter is susceptible to the manufacturing variances, and thus the characteristics deteriorate.

An objective of the present invention is to provide a ridge waveguide and a coaxial waveguide converter that are unsusceptible to the manufacturing variances over a broad bandwidth.

Solution to Problem

In an exemplary aspect of the present invention, a ridge waveguide having a ridge includes a projection that projects from the ridge toward a side of a waveguide space, in which an amount of projection of the projection decreases gradually from an end surface of the ridge waveguide on a side of a coaxial line along a waveguide direction of the ridge waveguide, a through-hole reaching the waveguide space of the ridge waveguide is provided in the projection, the through-hole is disposed at a position displaced from a center of the ridge waveguide in a direction perpendicular to a direction in which the projection projects in the end surface of the ridge waveguide on the side of the coaxial line, and an inner conductor of the coaxial line is inserted in the through-hole.

In another exemplary aspect of the present invention, a coaxial waveguide converter includes a ridge waveguide having a ridge and a coaxial line that is contactlessly and electromagnetically coupled to the ridge waveguide from an E-plane of the ridge waveguide, in which a projection projecting toward a side of a waveguide space of the ridge waveguide is provided in the ridge of the ridge waveguide, an amount of projection of the projection decreases gradually from an end surface of the ridge waveguide on a side of the coaxial line along a waveguide direction of the ridge waveguide, a through-hole reaching the waveguide space of the ridge waveguide is provided in the projection, and an inner conductor of the coaxial line is inserted in the through-hole at a position displaced from a center of the ridge waveguide in a direction perpendicular to a direction in which the projection projects in the end surface of the ridge waveguide on the side of the coaxial line.

Advantageous Effects of Invention

According to the present invention, it is possible to provide the ridge waveguide and the coaxial waveguide converter that are unsusceptible to manufacturing variances over a broad bandwidth.

DESCRIPTION OF EMBODIMENTS

Figure 1:
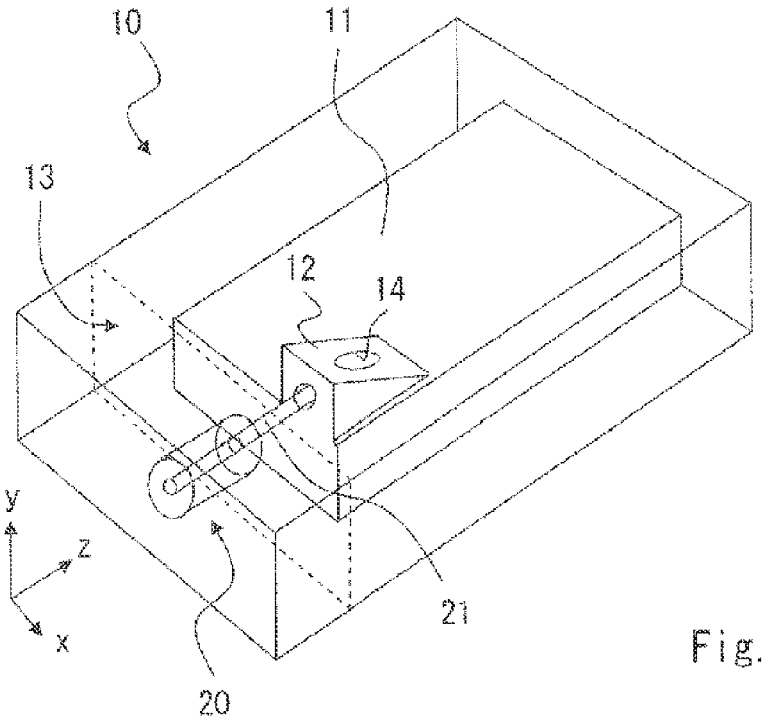
FIG. 1 is a perspective diagram showing a configuration of a coaxial waveguide converter according to an exemplary embodiment of the present invention.

An exemplary embodiment of the present invention is explained with reference to the attached drawings. The exemplary embodiment explained below is an example of the present invention, and the present invention is not limited to the following exemplary embodiment. Note that components denoted by the same reference numerals in the specification and drawings indicate the same components.

A configuration of a coaxial waveguide converter according to the present invention is explained using FIG. 1. The coaxial waveguide converter according to the present invention includes a ridge waveguide 10 having a ridge 11 and a coaxial line 20 that is contactlessly and electromagnetically coupled to the ridge waveguide 10 from an E-plane. A projection 12 projecting toward a waveguide space 13 side of the ridge waveguide 10 is provided in the ridge 11 of the ridge waveguide 10. The amount of projection of the projection 12 decreases gradually from an end surface on the coaxial line side of the ridge waveguide 10 along a waveguide direction (z direction) of the ridge waveguide 10. A through-hole 14 reaching the waveguide space 13 of the ridge waveguide 10 is provided in the projection 12. An inner conductor 21 of the coaxial line 20 is inserted in the through-hole 14 at a position displaced from the center of the ridge waveguide 10 in the direction (x direction) that is perpendicular to the direction (y direction) in which the projection 12 projects in an end surface of the ridge waveguide 10 on the coaxial line side. Then, it is possible to realize a coaxial waveguide converter that is insusceptible to manufacturing variances over a broad bandwidth.

Figure 2:
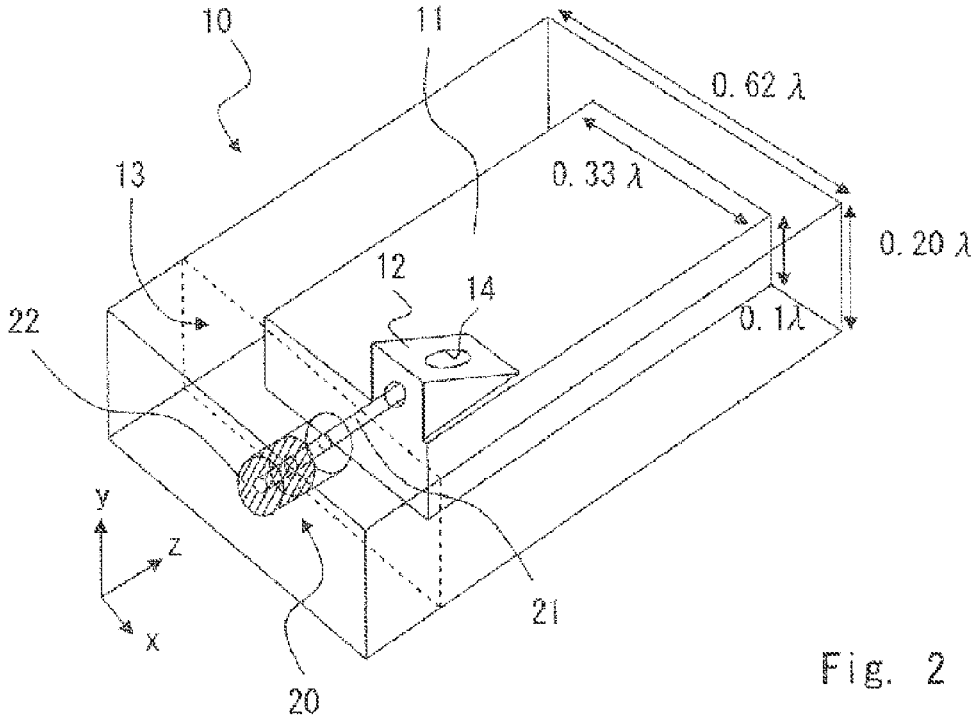
FIG. 2 is a perspective diagram showing the configuration of the coaxial waveguide converter according to a first exemplary embodiment of the present invention.
Figure 3:
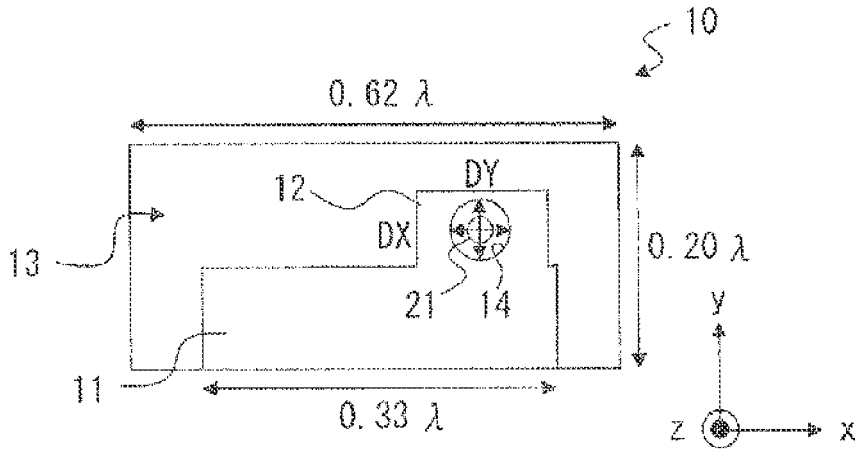
FIG. 3 is a front elevational view showing the configuration of the coaxial waveguide converter according to the first exemplary embodiment of the present invention.
Figure 4:
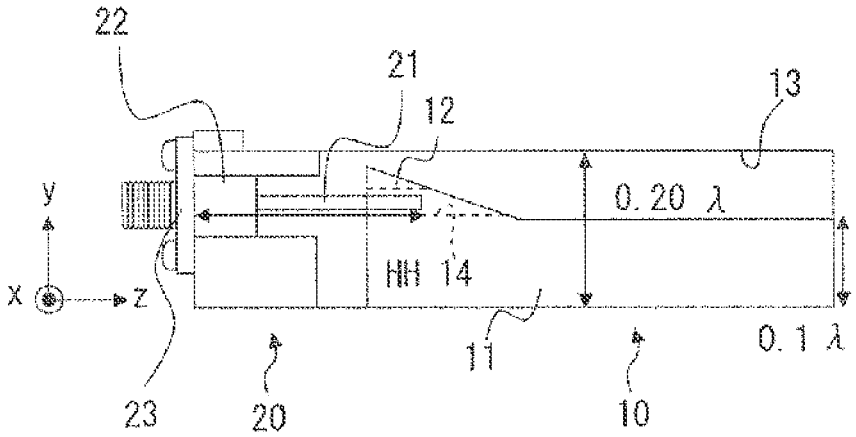
FIG. 4 is a perspective diagram showing the configuration of the coaxial waveguide converter according to the first exemplary embodiment of the present invention.

A specific configuration of the coaxial waveguide converter is explained using FIGS. 2 to 4. FIG. 2 is a perspective diagram schematically showing the configuration of the coaxial waveguide converter. FIG. 3 is a front elevational view showing the configuration of the coaxial waveguide converter. FIG. 4 is a side view showing the configuration of the coaxial waveguide converter. Note that in this example, a three-dimensional orthogonal coordinate system is used for the explanation as shown in FIGS. 2 to 4. The waveguide direction shall be a z direction, and orthogonal directions that are perpendicular to the waveguide direction shall be x and y directions, respectively. In the following explanation, the x direction shall be a width direction and the y direction shall be a height direction. Moreover, the z direction is a waveguide direction of the ridge waveguide 10.

The coaxial waveguide converter includes the coaxial line 20 and the ridge waveguide 10. The coaxial line 20 includes the inner conductor 21 and a dielectric 22. The inner conductor 21 is provided at the center of the dielectric 22. Therefore, the circumference of the inner conductor 21 made of metal is surrounded by the dielectric 22. The inner conductor 21 is contactlessly and electromagnetically coupled to the ridge waveguide 10. In the part coupled to the ridge waveguide 10, the inner conductor 21 is disposed along the z direction. Therefore, the inner conductor 21 is inserted in the waveguide space 13 of the ridge waveguide 10 from the E-plane (electric field surface) of the ridge waveguide 10. Note that the E-plane is a plane parallel to an xy plane.

The ridge waveguide 10 includes the ridge 11. Then, the waveguide space 13 is formed in an almost concave shape in its cross section, as shown in FIG. 3. The ridge 11 is disposed at the center of the ridge waveguide 10 in the x direction. Thus, the sizes of both sides of the waveguide space 13 of the ridge 11 in the x direction are equal. The ridge 11 is formed of a conductor such as metal. With the ridge 11 being formed, the ridge waveguide 10 becomes a single waveguide tube. It is obvious that a circumference of the waveguide space 13 is surrounded by an outer conductor (not shown) made of metal.

For example, the width of the waveguide space 13 is $0.62\lambda$, and the height of the waveguide space 13 is $0.20\lambda$. The width of the ridge 11 is $0.33\lambda$, and the height of the ridge 11 is $0.1\lambda$. Note that $\lambda$ is a wavelength corresponding to a design frequency.

Further, the projection 12 projecting toward the y direction is provided in the ridge 11. Accordingly, the size of the waveguide space 13 in the y direction is small only in the part where the projection 12 is provided in the x direction. The projection 12 is a rectangular shape on the xy plane shown in FIG. 3. Then, as shown in FIGS. 2 and 4, the amount of projection of the projection 12 decreases gradually along the waveguide direction (z direction). In this example, the projection 12 is a triangular shape on a yz plane shown in FIG. 4.

In other words, the projection 12 is formed in a triangular prism with a surface parallel to the yz plane as a bottom surface. As mentioned above, the projection 12 with its amount of projection gradually decreasing along the waveguide direction is provided in the ridge 11. As shown in FIG. 4, the projection 12 has a triangular shape in the side view (yz plane). Then, the surface of the projection 12 can be made flat. This facilitates manufacturing of the ridge waveguide 10. When the ridge 11 with its cross section being the rectangular shape and the projection 12 with its cross section being the rectangular shape are joined, the joined cross section presents a convex shape.

Furthermore, the projection 12 is disposed displacing from the center of the waveguide space 13 in the x direction. In this example, the projection 12 is displaced in the +x direction from the center of the waveguide space 13. Therefore, the sizes of the waveguide space 13 on both sides of the projection 12 in the x direction are different. In this example, as shown in FIG. 3, the waveguide space 13 on the +x side of the projection 12 is smaller than the waveguide space 13 on the −x side.

The through-hole 14 is formed in the projection 12. The through-hole 14 is disposed at the center of the projection 12 on the xy plane. The through-hole 14 penetrates from the end surface of the ridge waveguide 10 on the coaxial line side to the waveguide space 13. The inner conductor 21 is inserted in this through-hole 14. The through-hole 14 is a circular shape on the xy plane. The through-hole 14 is provided in parallel to the z direction. The diameter of the through-hole 14 is about 1.5 times greater than the diameter of the inner conductor 21. With the diameter of the through-hole 14 being 1.5 times greater than the diameter of the inner conductor, it is possible to prevent the inner conductor 21 from coming into contact with the ridge 11. That is, the inner conductor 21 will not come into contact with metal even with a slight manufacturing variance. Then, the inner conductor 21 and the ridge waveguide 10 contactlessly and electromagnetically coupled. The through-hole 14 is surrounded by the conductor of the projection 12 on the xy plane.

As shown in FIG. 4, the coaxial line 20 is connected to the ridge waveguide 10 by a connector 23. In detail, the connector 23 fixes the coaxial line 20 to the ridge waveguide 10 so that the inner conductor 21 may be inserted in the through-hole 14 from the E-plane (electric field plane) of the ridge waveguide 10. As the connector 23, a commercially available SMA connector can be used, for example. Impedance matching can be achieved by parameter searching for an insertion length of the connector 23 and the shape of the projection 12. In other words, impedance can be matched by adjusting the insertion length of the inner conductor 21 and the shape of the projection 12. This achieves the impedance matching relatively easily.

The inner conductor 21 of the coaxial line 20 is electromagnetically coupled to the ridge 11 of the ridge waveguide 10. That is, the inner conductor 21 is RF-coupled to the ridge waveguide 10 via the projection 12. Electromagnetic field distribution of the ridge waveguide 10 is close to a dual conductor system TEM mode that regards the ridge 11 as the inner conductor 21. As the ridge waveguide 10 has a lower cutoff frequency, the ridge waveguide 10 is used as a transmission line over a broad bandwidth. Electromagnetic field distribution in the cross section of the ridge waveguide 10 resembles electromagnetic field distribution of the coaxial line 20. For this reason, when the inner conductor 21 of the coaxial line 20 is electromagnetically coupled to the ridge 11 of the ridge waveguide 10, impedance matching can be achieved relatively easily.

Moreover, the position where the inner conductor 21 is electromagnetically coupled to the ridge 11 is displaced from the center of the ridge waveguide. Specifically, the through-hole 14 is disposed at a position displaced from the center of the ridge waveguide 10 in the direction (x direction) that is perpendicular to the direction (y direction) in which the projection 12 projects in the end surface of the ridge waveguide 10 on the coaxial line 20 side. Then, a frequency at which double resonance occurs in the impedance can be moved. Appropriately choosing the position of the through-hole in this way allows an increase in the bandwidth more than when the projection 12 is disposed at the center.

This further reduces the deterioration in the characteristics due to the manufacturing variances. Specifically, deterioration in the return loss characteristics can be prevented even when the manufacturing variances occur. For example, the manufacturing variances in the through-hole 14 shall be DX and DY. As shown in FIG. 3, DX is displacement from the center of the through-hole 14 at the center of the inner conductor 21 in the x direction, and DY is displacement from the center of the through-hole 14 at the center of the inner conductor 21 in the y direction. That is, when the center of the through-hole 14 and the center of the inner conductor 21 match on the xy plane, DX and DY are zero. Additionally, as shown in FIG. 4, the insertion length of the inner conductor 21 shall be HH. When the insertion length HH is displaced from a design value, an end position of the inner conductor 21 is displaced from a design value. These variances are prone to occur at the time of manufacturing.

Figure 5:
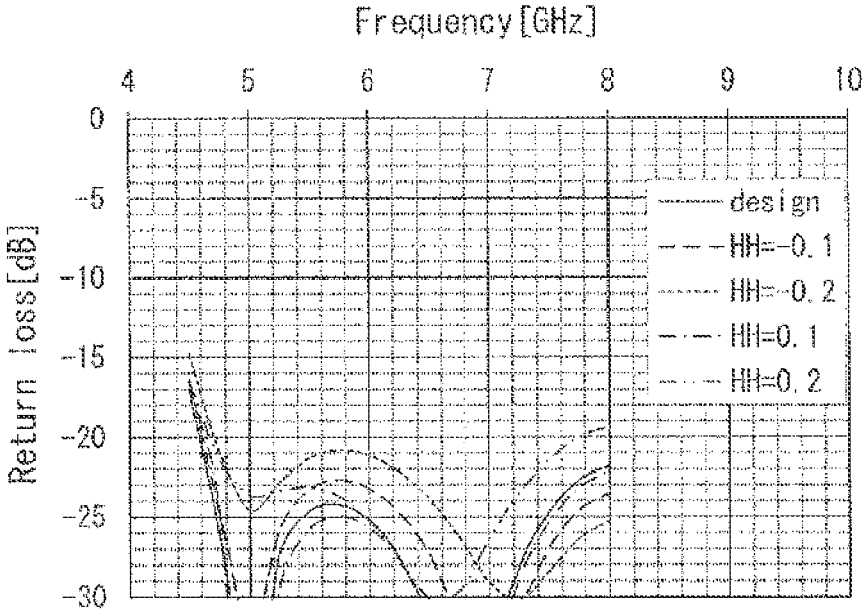
FIG. 5 is a graph showing characteristics of the coaxial waveguide converter according to this exemplary embodiment of the present invention.
Figure 6:
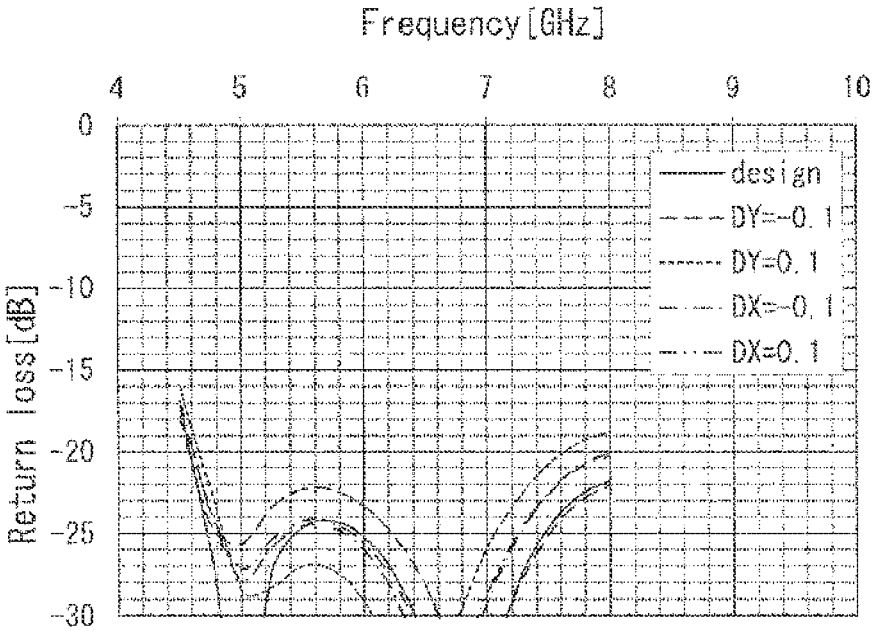
FIG. 6 is a graph showing characteristics of the coaxial waveguide converter according to this exemplary embodiment of the present invention.
Figure 7:
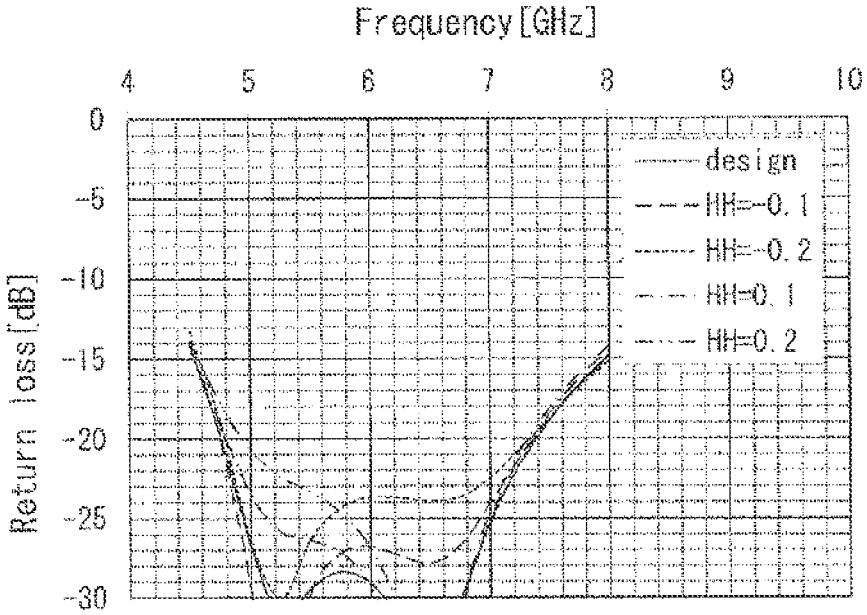
FIG. 7 is a graph showing characteristics of the coaxial waveguide converter when a projection is disposed at the center.
Figure 8:
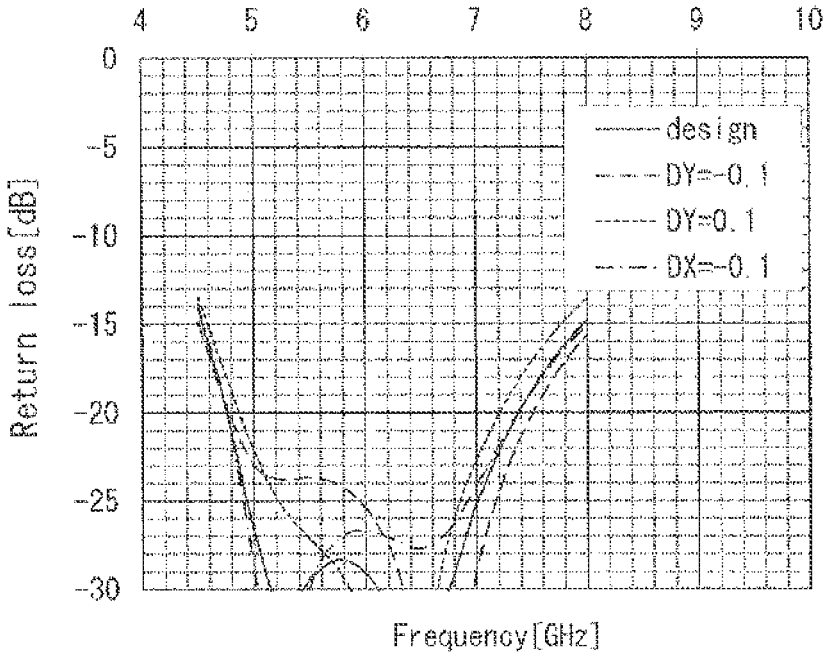
FIG. 8 is a graph showing characteristics of the coaxial waveguide converter when the projection is disposed at the center.
Figure 9:
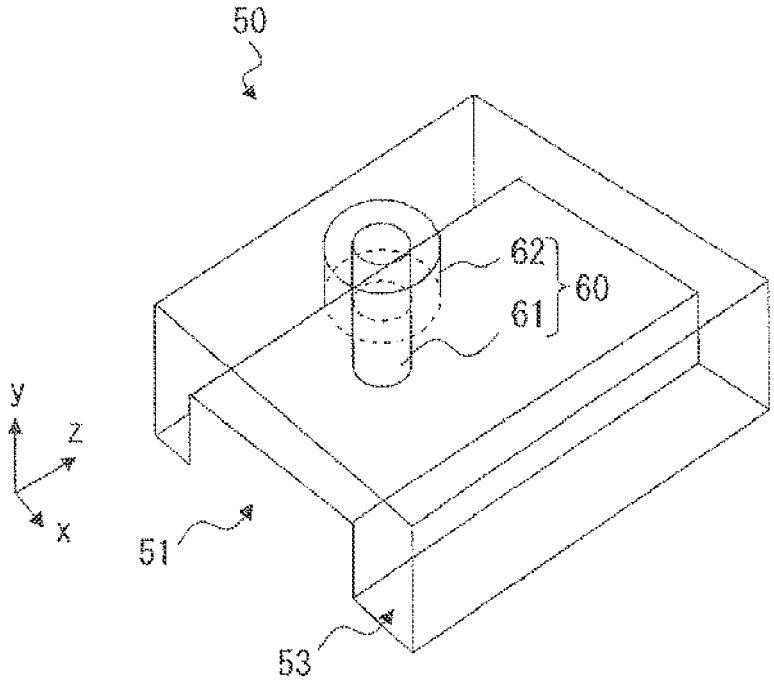
FIG. 9 is a perspective diagram showing a configuration of the coaxial waveguide converter using H plane electromagnetic field coupling.
Figure 10:
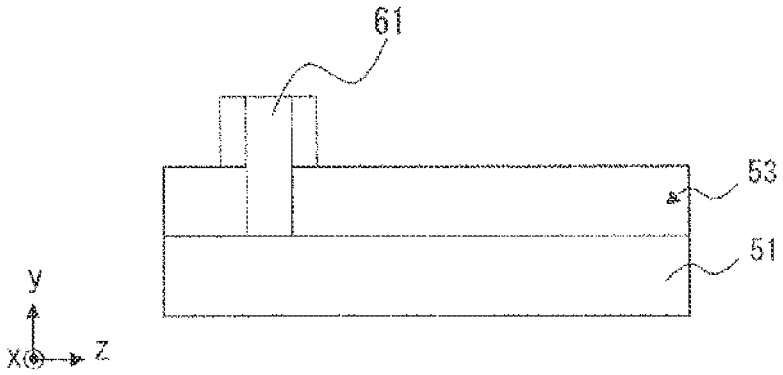
FIG. 10 is a side view showing a configuration of a short circuit coaxial waveguide converter using the H-plane electromagnetic field coupling.
Figure 11:
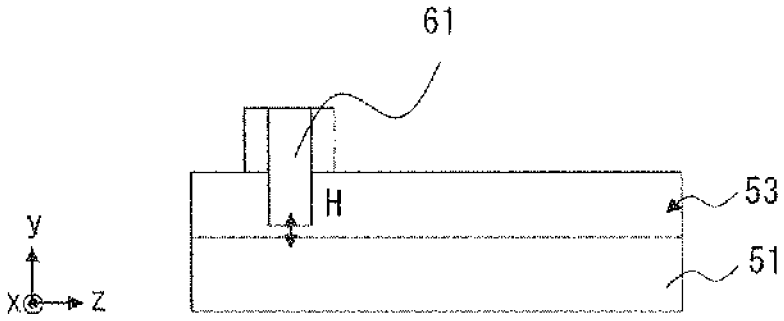
FIG. 11 is a side view showing the configuration of an open circuit coaxial waveguide converter using the H-plane electromagnetic field coupling.
Figure 12:
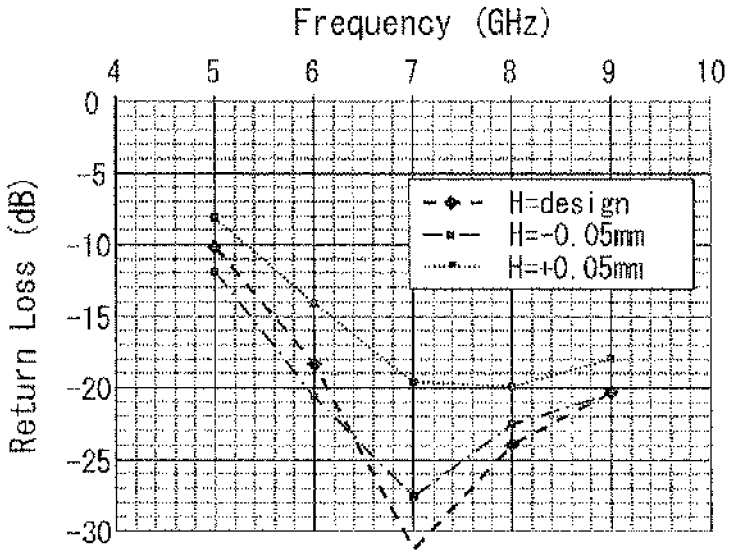
FIG. 12 is a graph showing characteristics of the coaxial waveguide converter shown in FIG. 10.
Figure 13:
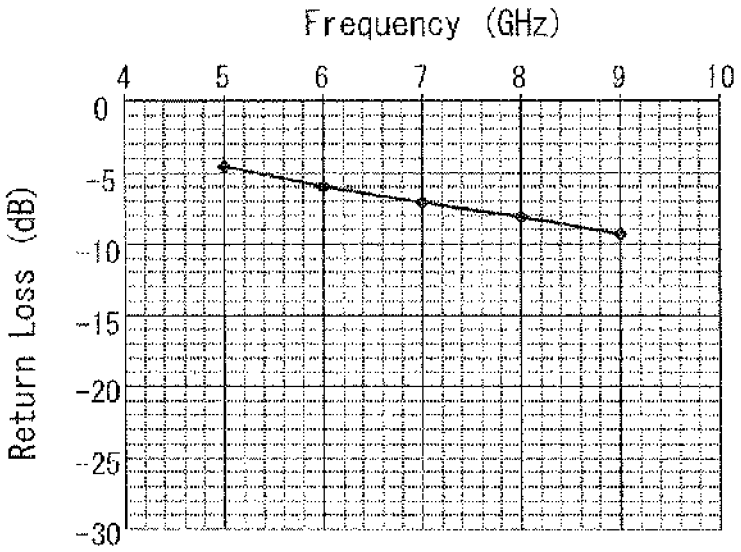
FIG. 13 is a graph showing characteristics of the coaxial waveguide converter shown in FIG. 11.

The characteristics of the coaxial waveguide converter according to this exemplary embodiment are explained using FIGS. 5 to 8. FIGS. 5 and 6 are graphs showing frequency characteristics of return loss of the coaxial waveguide converter according to this exemplary embodiment. FIGS. 7 and 8 are diagrams showing frequency characteristics of the return loss when the projection 12 is disposed at the center of the waveguide space 13 in the x direction in the coaxial waveguide converter shown in FIGS. 2 to 4. FIGS. 5 and 7 show frequency characteristics along with changes in HH from the design value. Moreover, FIGS. 6 and 8 show frequency characteristics along with changes in DX and DY from the design values. The frequency characteristics of the return loss of a 6.5 GHz band model are explained here.

In the coaxial waveguide converter according to this exemplary embodiment, the return loss will not deteriorate below −20 dB even with twice or more of the manufacturing variance value in H. Similarly, in the coaxial waveguide converter according to this exemplary embodiment, the return loss will not deteriorate below −20 dB even with twice or more of the manufacturing variance values in DX and DY. It is possible to prevent the return loss from deteriorating in this way even when the inner conductor 21 is displaced from the center of the through-hole 14. In addition, with comparison in the fractional bandwidth with the return loss being lower or equal to −20 dB, the fractional bandwidth are about 30% when the projection 12 is disposed at the center, while the fractional bandwidth are about 45% with the configuration according to the present invention. Thus, further broadband characteristics can be realized.

In the ridge waveguide 10, the inner conductor 21 of the coaxial line 20 is inserted into the ridge waveguide 10 from the E-plane. Then, the ridge 11 and the inner conductor 21 are contactlessly and electromagnetically coupled. This realizes the coaxial waveguide connection converter that is insusceptible to the manufacturing variances and also over a broad bandwidth.

Furthermore, the inner conductor of the coaxial line 20 inserted into the ridge waveguide 10 from the E-plane is contactlessly and electromagnetically coupled to the projection 12 projecting from the ridge 11. A hole with a diameter 1.5 times greater than the diameter of the inner conductor 21 is provided in the projection 12. This assures prevention of contact between the inner conductor 21 and the projection 12. The projection 12 is disposed at a position displaced from the center of the ridge waveguide 10 in the x direction, as shown in FIG. 3.

Impedance matching is achieved mainly by the insertion length of the inner conductor 21 and the shape of the projection 12. The diameter of the inner conductor 21 can be designed using the size of a common SMA connector. More specifically, the size of the through-hole 14 can be designed with the size to allow the inner conductor 21 used for the SMA connector to be inserted in the through-hole 14. As described above, this realizes broadband characteristics of about 45% in the band of the return loss less than or equal to −20 dB even when the manufacturing variances occur. Since the coaxial waveguide converter according to this exemplary embodiment can be contactlessly connected, characteristics can be stabilized. Furthermore, as the coaxial waveguide converter is insusceptible to the manufacturing variances, the coaxial waveguide converter has great potential as a standard connection circuit configuration.

Although the present invention has been explained with reference to the exemplary embodiment so far, the present invention is not limited by above. Various modifications understandable by a person skilled in the art within the scope of the invention can be made to the configurations and details of the present invention.

The present application claims priority rights of and is based on Japanese Patent Application No. 2011-12702 filed on Jan. 25, 2011 in the Japanese Patent Office, the entire contents of which are hereby incorporated by reference.

INDUSTRIAL APPLICABILITY

The coaxial waveguide converter according to the present invention can be applied to a connection part of a RF (Radio Frequency) transmission/reception separating circuit in an input unit of a simple wireless device.

REFERENCE SIGNS LIST

10 RIDGE WAVEGUIDE
11 RIDGE
12 PROJECTION
13 WAVEGUIDE SPACE
14 THROUGH-HOLE
20 COAXIAL LINE
21 INNER CONDUCTOR
22 DIELECTRIC
23 CONNECTOR
50 RIDGE WAVEGUIDE
51 RIDGE
53 WAVEGUIDE SPACE
60 COAXIAL LINE
61 INNER CONDUCTOR
62 DIELECTRIC

The invention claimed is:

1. A coaxial waveguide converter comprising a ridge waveguide including a ridge, the ridge waveguide comprising:

a projection on a top surface of the ridge that projects from an end of the ridge on a side of a coaxial line toward a side of a waveguide space between a waveguide and the ridge, wherein an amount of projection of the projection decreases gradually from the end of the ridge on the side of the coaxial line along a waveguide direction of the ridge waveguide, a through-hole parallel to the top surface of the ridge reaching the waveguide space of the ridge waveguide is provided in the projection, the through-hole is disposed at a position displaced from a center of the ridge waveguide in a direction perpendicular to a direction in which the projection projects from the end of the ridge on the side of the coaxial line, and an inner conductor of the coaxial line is inserted in the through-hole.

2. The ridge waveguide according to claim 1, wherein the projection is a triangular shape in a side view including the waveguide direction.

3. The ridge waveguide according to claim 1, wherein the projection is a rectangular shape on the end of the ridge on the side of the coaxial line.

4. The ridge waveguide according to claim 3, wherein the through-hole is disposed at a center of the projection on the end of the ridge on the side of the coaxial line.

5. A coaxial waveguide converter comprising:

a ridge waveguide including a ridge; and a coaxial line that is contactlessly and electromagnetically coupled to the ridge waveguide from an E-plane of the ridge waveguide, wherein the ridge comprises a projection on a top surface of the ridge projecting toward a side of a waveguide space of the ridge waveguide between a waveguide and the ridge from an end of the ridge on a side of the coaxial line, an amount of projection of the projection decreases gradually from the end of the ridge on the side of the coaxial line along a waveguide direction of the ridge waveguide, a through-hole parallel to the top surface of the ridge reaching the waveguide space of the ridge waveguide is provided in the projection, and an inner conductor of the coaxial line is inserted in the through-hole at a position displaced from a center of the ridge waveguide in a direction perpendicular to a direction in which the projection projects from the end of the ridge on the side of the coaxial line.

6. The coaxial waveguide converter according to claim 5, wherein the projection is a triangular shape in a side view including the waveguide direction.

7. The coaxial waveguide converter according to claim 5, wherein the projection is a rectangular shape on the end of the ridge on the side of the coaxial line.

8. The coaxial waveguide converter according to claim 5, wherein the through-hole is disposed at a center of the projection on the end of the ridge on the side of the coaxial line.

9. The coaxial waveguide converter according to claim 5, wherein a diameter of the through-hole is 1.5 times greater than a diameter of the coaxial line.

* * * * *